US008935076B2

(12) United States Patent
Ide et al.

(10) Patent No.: US 8,935,076 B2
(45) Date of Patent: Jan. 13, 2015

(54) CONTROLLER FOR INTERNAL COMBUSTION ENGINE

(75) Inventors: Koji Ide, Susono (JP); Takashi Nishikiori, Susono (JP); Masashi Shibayama, Kobe (JP); Yuusuke Oda, Kobe (JP)

(73) Assignees: Toyota Jidosha Kabushiki Kaisha, Toyota-Shi (JP); Fujitsu Ten Limited, Kobe-Shi (JP)

( * ) Notice: Subject to any disclaimer, the term of this patent is extended or adjusted under 35 U.S.C. 154(b) by 623 days.

(21) Appl. No.: 13/259,394

(22) PCT Filed: Mar. 29, 2010

(86) PCT No.: PCT/IB2010/000715

§ 371 (c)(1),
(2), (4) Date: Sep. 23, 2011

(87) PCT Pub. No.: WO2010/113014

PCT Pub. Date: Oct. 7, 2010

(65) Prior Publication Data

US 2012/0016565 A1 Jan. 19, 2012

(30) Foreign Application Priority Data

Mar. 30, 2009 (JP) ..... 2009-082658

(51) Int. Cl.

| | |
|---|---|
| ***F01L 1/344*** | (2006.01) |
| ***F01L 13/00*** | (2006.01) |
| ***F01L 1/26*** | (2006.01) |
| *F01L 1/18* | (2006.01) |
| *F02D 41/20* | (2006.01) |

(52) U.S. Cl.

CPC ..... *F01L 13/0036* (2013.01); *F01L 1/267* (2013.01); *F01L 1/3442* (2013.01);
(Continued)

(58) Field of Classification Search

CPC ..... Y02T 10/18; Y02T 10/42; F01L 1/344; F01L 1/34406; F01L 1/0073

USPC ..... 701/102, 103, 105, 110; 123/90.17, 123/90.15, 90.16, 90.31, 345, 90.11

See application file for complete search history.

(56) References Cited

U.S. PATENT DOCUMENTS 5,363,817 A * 11/1994 Ikeda et al. ..... 123/90.15
5,803,029 A 9/1998 Yoshihara et al.

(Continued)

FOREIGN PATENT DOCUMENTS

DE 19739506 A1 3/1998
EP 1111204 A2 6/2001

(Continued)

OTHER PUBLICATIONS

International Search Report issued Jul. 6, 2010 in PCT/IB2010/000715 & Written Opinion.

*Primary Examiner* — Hai Huynh
*Assistant Examiner* — Gonzalo Laguarda
(74) *Attorney, Agent, or Firm* — Kenyon & Kenyon LLP

(57) ABSTRACT

When the operating characteristics of an intake valve are changed by an intake valve stop mechanism, an ECU outputs a command signal (control on) to a solenoid. At this time, a timing, at which the command signal is output to the solenoid, is determined on the basis of a rotational position of a crankshaft, calculated from a signal of a crank position sensor. However, the output timing is corrected on the basis of a rotational phase difference of a camshaft with respect to the crankshaft.

11 Claims, 8 Drawing Sheets

(52) U.S. Cl.
CPC ..... *F01L 13/0005* (2013.01); *F01L 1/185* (2013.01); *F01L 2013/0052* (2013.01); *F01L 2105/00* (2013.01); *F01L 2800/12* (2013.01); *F01L 2820/031* (2013.01); *F01L 2820/041* (2013.01); *F01L 2820/042* (2013.01); *F02D 41/20* (2013.01)
USPC ..... 701/102; 123/90.15; 123/90.16; 123/90.17

(56) References Cited

U.S. PATENT DOCUMENTS

| | | | | |
|---|---|---|---|---|
| 5,860,328 | A * | 1/1999 | Regueiro | 74/568 R |
| 5,931,128 | A * | 8/1999 | Murata et al. | 123/90.17 |
| 6,357,404 | B1 | 3/2002 | Deeg et al. | |
| 6,920,852 | B2 * | 7/2005 | Machida | 123/90.16 |
| 7,243,625 | B2 * | 7/2007 | Shindou | 123/90.16 |
| 7,278,383 | B2 * | 10/2007 | Kamiyama et al. | 123/48 C |
| 2007/0186888 | A1 | 8/2007 | Herold et al. | |
| 2007/0227483 | A1 | 10/2007 | Inoue et al. | |

FOREIGN PATENT DOCUMENTS

| | | | |
|---|---|---|---|
| JP | 2003-074385 | A | 3/2003 |
| JP | 2003-120375 | A | 4/2003 |
| JP | 2003-254017 | A | 9/2003 |
| JP | 2006-520869 | A | 9/2006 |
| WO | 2004/083611 | A1 | 9/2004 |
| WO | 2005090766 | A1 | 9/2005 |
| WO | 2009/136551 | A1 | 11/2009 |

* cited by examiner

CONTROLLER FOR INTERNAL COMBUSTION ENGINE

This is a 371 national phase application of PCT/IB2010/000715 filed 29 Mar. 2010, which claims priority to Japanese Patent Application No. 2009-082658 filed 30 Mar. 2009, the contents of which are incorporated herein by reference.

BACKGROUND OF THE INVENTION

1. Field of the Invention

The invention relates to a controller for an internal combustion engine and more particularly, to a controller for an internal combustion engine that includes a rotational phase difference changing mechanism that changes the rotational phase difference of a camshaft with respect to a crankshaft and a valve operating characteristic changing mechanism that changes the operating characteristics of a valve with respect to the rotation of the camshaft.

2. Description of the Related Art

Published Japanese Translation of PCT Application No. 2006-520869 (JP-A-2006-520869) describes a valve mechanism that is able to change the operating characteristics of a valve. The valve mechanism includes a cam carrier that is immovable in the rotational direction and movable in the axial direction with respect to a camshaft. The cam carrier has a cam having two different cam tracks. The cam carrier is moved in the axial direction by an actuator device to switch between the cam tracks of the cam that actuates the valve. By so doing, the operating characteristics of the valve are changed.

In the valve mechanism described in JP-A-2006-520869, a mechanism that includes a spiral groove formed in the cam carrier and an electric actuator that engages or disengages a drive pin with or from the groove is used as the actuator device that moves the cam carrier in the axial direction. When the drive pin is engaged with the groove by the electric actuator during rotation of the camshaft, the cam carrier moves in the axial direction through contact between the drive pin and the groove.

JP-A-2006-520869 does not specifically describe the timing at which the drive pin is engaged with the spiral groove. However, it is important how to control the above timing in control on the valve mechanism. If the timing at which the drive pin is actuated is wrong, it is difficult to properly engage the drive pin with the spiral groove. As a result, there is a possibility that the operating characteristics of a valve cannot be changed or the operating characteristics of a valve are changed with a delay. When the valve mechanism is a valve stop mechanism described in Japanese Patent Application Publication No. 2003-074385 (JP-A-2003-074385), it is difficult to stop a valve at a desired timing. Furthermore, if the drive pin fails to be properly engaged with the spiral groove, there is a concern that the groove and/or the drive pin wear or there is a concern that the drive pin is damaged.

Generally, the timings of various controls in an internal combustion engine are mostly controlled by a signal from a crank position sensor. This may also be applied to the valve mechanism described in JP-A-2006-520869. That is, the timing at which the drive pin is actuated may be determined on the basis of a crank position calculated from a signal of a crank position sensor.

Incidentally, when an internal combustion engine includes a variable valve timing mechanism described in Japanese. Patent Application Publication No. 2003-254017 (JP-A-2003-254017), there is a concern that the timing at which the drive pin is actuated is wrong. This is because, as the variable valve timing mechanism operates, the rotational phase difference of the camshaft with respect to the crankshaft is changed and then the positional relationship of the spiral groove with respect to the crankshaft also changes. When the timing is controlled on the basis of a signal from the crank position sensor, the variable valve timing mechanism operates to make it difficult to engage the drive pin with the groove at an appropriate timing.

SUMMARY OF THE INVENTION

The invention provides a controller for an internal combustion engine, which is able to smoothly change the operating characteristics of a valve with respect to the rotation of a camshaft even when the rotational phase difference of the camshaft with respect to a crankshaft is changed.

An aspect of the invention provides a controller for an internal combustion engine that includes a rotational phase difference changing mechanism that changes a rotational phase difference of a camshaft with respect to a crankshaft; a guide passage that is restricted from rotating relative to the camshaft; a guided member that is able to be engaged with or disengaged from the guide passage; an operating member that is displaced in an axial direction of the camshaft through a relative displacement in the axial direction between the guide passage and the guided member, the relative displacement being caused by the rotation of the camshaft; a valve operating characteristic changing mechanism that changes operating characteristics of a valve with respect to the rotation of the camshaft through a displacement of the operating member; and an actuator that receives an input command signal to drive the guided member to thereby engage the guided member with the guide passage. The controller includes: a crank position calculation unit that calculates a rotational position of the crankshaft; a rotational phase difference calculation unit that calculates a rotational phase difference of the camshaft with respect to the crankshaft, the rotational phase difference being changed by the rotational phase difference changing mechanism; an instruction unit that outputs a command signal to the actuator when the operating characteristics of the valve are changed and that determines a timing, at which the command signal is output to the actuator, on the basis of the rotational position of the crankshaft; and a timing correction unit that corrects the timing, at which the command signal is output by the instruction unit, on the basis of the rotational phase difference of the camshaft with respect to the crankshaft.

With the above controller, when the guided member is driven by the actuator to engage the guided member with the guide passage, the operating member is displaced in the axial direction of the camshaft through a relative displacement in the axial direction between the guide passage and the guided member, which is caused by the rotation of the camshaft. The operating member is displaced in the axial direction of the camshaft, so the operating characteristic of the valve with respect to the rotation of the camshaft are changed by the valve operating characteristic changing mechanism. When the operating characteristics of the valve are changed as described above, the timing, at which the command signal is output to the actuator, is determined on the basis of the rotational position of the crankshaft; however, the output timing is corrected depending on the rotational phase difference of the camshaft with respect to the crankshaft. Thus, even when the rotational phase difference changing mechanism is actuated to change the rotational phase difference of the camshaft with respect to the crankshaft, it is possible to engage the guided member with the guide passage at an appropriate timing, and it is possible to smoothly change the operating characteristics of the valve with respect to the rotation of the camshaft.

In addition, in the internal combustion engine, the guide passage may be restricted from being displaced in the axial direction with respect to the camshaft, and the operating member may be restricted from being displaced in the axial direction with respect to the guided member.

With the above controller, the guide passage is restricted from being displaced in the axial direction with respect to the camshaft, so the guided member is guided into the guide passage by the rotation of the camshaft and is displaced in the axial direction. In addition, the operating member is restricted from being displaced in the axial direction with respect to the guided member, so the operating member is also guided to be displaced in the axial direction as the guided member is guided by the guide passage. That is, the operating member is displaced in the axial direction with reference to the guide passage, and, by so doing, it is possible to change the operating characteristics of the valve with respect to the rotation of the camshaft.

In addition, in the controller, the timing correction unit may further correct the timing, at which the command signal is output by the instruction unit, on the basis of a response delay time of the actuator with respect to the command signal and a rotational speed of the crankshaft.

With the above controller, the timing, at which the command signal is output to the actuator, is corrected on the basis of a response delay time of the actuator with respect to the command signal and a rotational speed of the crankshaft. Thus, it is possible to engage the guided member with the guide passage at an appropriate timing without any influence of the rotational speed of the crankshaft (that is, the rotational speed of the internal combustion engine).

In addition, the controller may further include a prohibiting unit that determines whether the rotational phase difference changing mechanism can normally operate, and that prohibits the instruction unit from outputting the command signal when the rotational phase difference changing mechanism cannot normally operate.

With the above controller, when the rotational phase difference changing mechanism cannot normally operate, the actuator is prohibited from outputting the command signal. Thus, it is possible to prevent the guided member from being engaged with the guide passage at a wrong timing.

In addition, the internal combustion engine may have the valve operating characteristic changing mechanism, the operating member, the guide passage, the guided member and the actuator in each of an intake side and an exhaust side, the controller may have the instruction unit in each of the intake side and the exhaust side, and may have the rotational phase difference changing mechanism, the rotational phase difference calculation unit and the timing correction unit in at least one of the intake side and the exhaust side, and the controller may further include a determination unit that determines whether timings, at which command signals are respectively output to the intake side and the exhaust side and which are corrected by the timing correction unit, overlap, and a timing adjustment unit that, when the output timings overlap, adjusts the timings, at which the command signals are output to the intake side and the exhaust side, so as to cancel the overlap.

With the above controller, when the timings, at which the command signals are output to the actuators of the intake side and the exhaust side, overlap, the timings, at which the command signals are output to the intake side and the exhaust side, are adjusted so as to cancel the overlap. Thus, it is possible to prevent a load for operating the actuators from becoming excessive.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
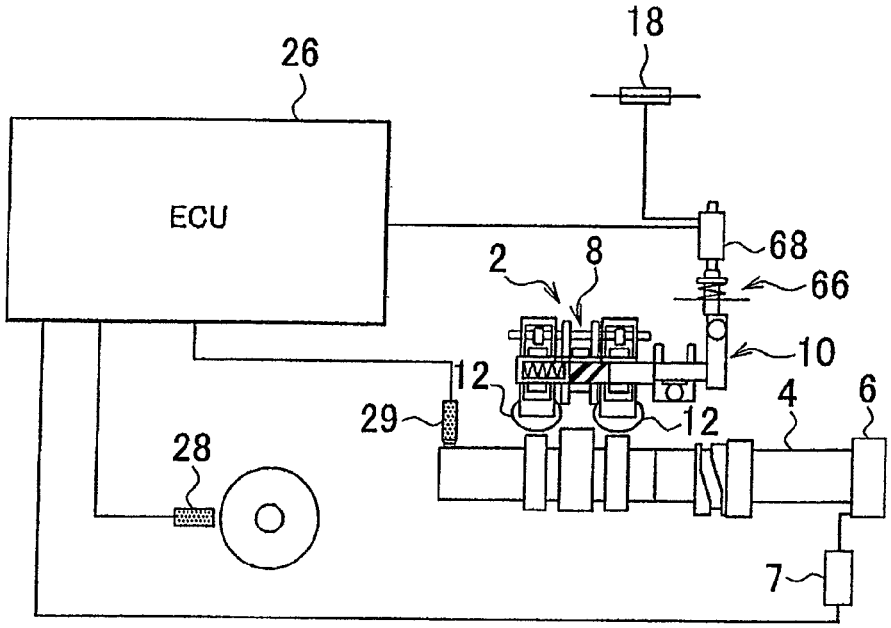
FIG. 1 is a schematic view that shows the overall configuration of a controller for an internal combustion engine according to a first embodiment of the invention.

Hereinafter, a first embodiment of the invention will be described with reference to FIG. 1 to FIG. 7. FIG. 1 is a schematic view that shows the overall configuration of a controller for an internal combustion engine according to the first embodiment of the invention. A valve drive system shown in the drawing is intended for intake valves 12. Two intake valves 12 are provided for each cylinder, and are driven by a common valve drive device 2. The valve drive device 2 converts rotation of a camshaft 4 into vertical reciprocating motion and then transmits the vertical reciprocating motion to the intake valves 12.

The camshaft 4 is provided with a variable valve timing mechanism (hereinafter, it may be referred to as VVT) 6. The variable valve timing mechanism 6 changes the rotational phase difference of the camshaft 4 with respect to the crankshaft (not shown) to thereby change the valve timings of the intake valves 12. The variable valve timing mechanism 6 includes a housing and a vane body. The housing is coupled to the crankshaft via a timing chain, and the like. The vane body is provided in the housing and installed at the end of the camshaft 4. Hydraulic pressure is supplied into a hydraulic pressure chamber defined by the housing and the vane body to thereby make it possible to rotate the vane body relative to the housing, and, by extension, to change the rotational phase difference of the camshaft 4 with respect to the crankshaft. Hydraulic pressure supplied to the variable valve timing mechanism 6 is controlled by a hydraulic pressure control valve 7 provided in a hydraulic pressure supply line. The structure of the variable valve timing mechanism 6 is known and the structure is not limited in the embodiment of the invention, so the further detailed description thereof is omitted.

The valve drive device 2 includes an intake valve stop mechanism 8 that stops the intake valves 12 in a closed state. The detailed configuration of the intake valve stop mechanism 8 will be described later. In addition, the valve drive device 2 includes a change-over mechanism 10 that drives the intake valve stop mechanism 8 to change the operating characteristics of the intake valves 12. The change-over mechanism 10 is provided with an actuator 66 for actuating the change-over mechanism 10. The actuator 66 used in the present embodiment uses a solenoid 68 as a drive device. A 12-V power supply 18 of a vehicle is used as a power supply for driving the solenoid 68.

The controller according to the present embodiment is formed of the above described various mechanisms and an electronic control unit (ECU) 26. The ECU 26 duty-controls the hydraulic pressure control valve 7 to thereby control the operation of the variable valve timing mechanism 6, and duty-controls the solenoid 68 to thereby control the operation of the change-over mechanism 10. In the present embodiment, control on the solenoid 68 for operating the change-over mechanism 10 is particularly important. The ECU 26 controls the solenoid 68 on the basis of the signal from a crank position sensor 28 and the signal from a cam position sensor 29.

The crank position sensor 28 is formed of a timing rotor and an electromagnetic pickup. The timing rotor is attached to the crankshaft. The timing rotor for the crank position sensor 28 has 34 signal teeth for detecting a top dead center with two teeth omitted. Those signal teeth are detected by the electromagnetic pickup to make it possible to measure the rotational position and rotational speed of the crankshaft. On the other hand, the cam position sensor 29 is formed of a timing rotor and an electromagnetic pickup. The timing rotor is attached to the camshaft 4. The timing rotor for the cam position sensor 29 has three protrusions. Those protrusions are detected by the electromagnetic pickup to make it possible to measure the approximate rotational position of the camshaft 4. The ECU 26 computes the rotational position (absolute position) of the crankshaft from the signal of the crank position sensor 28, and computes the rotational phase difference (relative position) of the camshaft 4 with respect to the crankshaft from the signal of the crank position sensor 28 and the signal of the cam position sensor 29. A specific control method for the solenoid 68 by the ECU 26 will be described in detail later.

Hereinafter, the valve drive device 2 according to the present embodiment, particularly, the configuration of the intake valve stop mechanism 8 and change-over mechanism 10, will be described in detail. First, the configuration of the intake valve stop mechanism 8 will be described with reference to FIG. 2. In the drawing, for the sake of easy illustration of the configuration of the valve drive device 2, the valve drive device 2 is displaced in the radial direction of the camshaft 4 from an original position at which the valve drive device 2 is mounted on the camshaft 4. In addition, for the sake of easy illustration of the internal configuration of the valve drive device 2, part of the outer shape of the valve drive device 2 is partially cut away.

Figure 2:
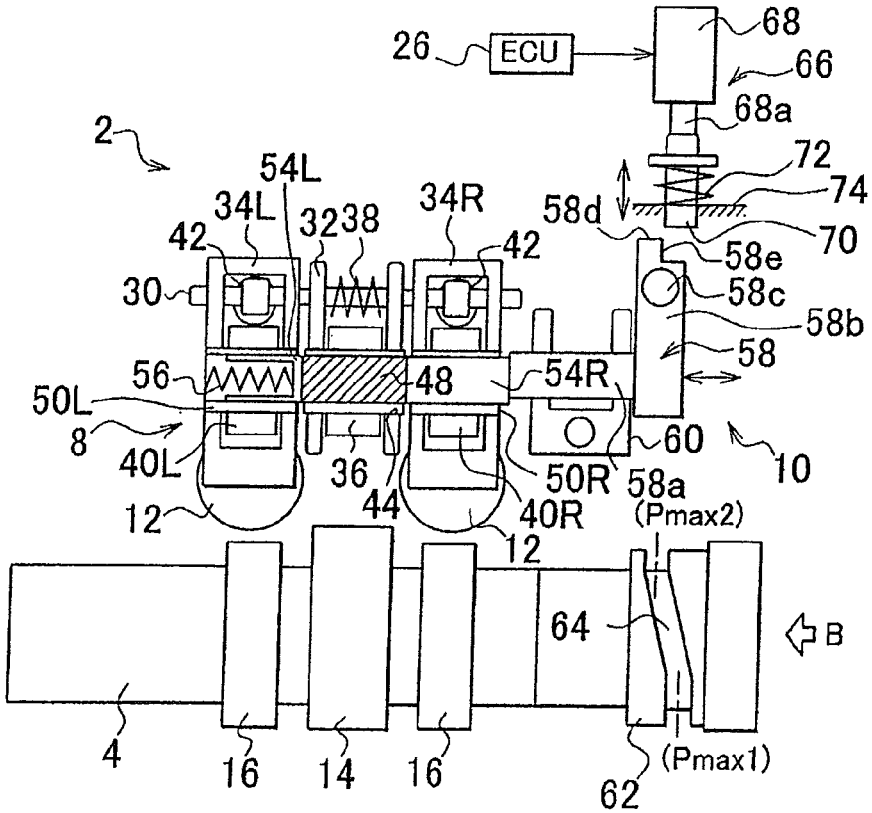
FIG. 2 is a view for illustrating the detailed configuration of a valve drive device shown in FIG. 1.

As shown in FIG. 2, the intake valve stop mechanism 8 includes a first rocker arm 32 and a pair of second rocker arms 34L and 34R. The pair of second rocker arms 34L and 34R are arranged respectively on both sides of the first rocker arm 32. These rocker arms 32, 34L and 34R are rockable about a common rocker shaft 30. The rocker shaft 30 is supported by a cylinder head via a pair of hydraulic lash adjusters 42.

The first rocker arm 32 is provided with a first roller 36. The first rocker arm 32 is urged by a torsion coil spring 38. This urging force presses the first roller 36 against a primary cam 14 formed on the camshaft 4. With the above configuration, the first rocker arm 32 rocks as the primary cam 14 rotates.

Movable ends of the second rocker arms 34L and 34R are respectively in contact with the ends of valve stems of the two intake valves 12. Each intake valve 12 is urged by a valve spring (not shown) in a closing direction. The camshaft 4 includes a pair of secondary cams 16 located respectively on both sides of the above described primary cam 14. Each secondary cam 16 has the shape of a perfect circle having a radius equal to the base circle of the primary cam 14. The second rocker arms 34L and 34R are respectively provided with rollers 40L and 40R. The outside diameters of the rollers 40L and 40R are equal to the outside diameter of the first roller 36 provided for the first rocker arm 32. In addition, the distance between the center of the rocker shaft 30 and the center of each of the rollers 40L and 40R is equal to the distance between the center of the rocker shaft 30 and the center of the first roller 36. When the intake valves 12 are closed, the rollers 40L and 40R are in contact with the secondary cams 16.

The intake valve stop mechanism 8 is a valve operating characteristic changing mechanism that switches between a state where the first rocker arm 32 is coupled to the second rocker arms 34L and 34R and a state where the first rocker arm 32 is separated from the second rocker arms 34L and 34R to thereby make it possible to instantaneously switch between a state where the intake valves 12 are operated and a state where the intake valves 12 are stopped in a closed state. Hereinafter, the workings of the above switching will be described.

The first rocker arm 32 has a sleeve 44 that is arranged concentrically with the first roller 36. The second rocker arms 34L and 344 respectively have sleeves 50L and 50R that are arranged concentrically with the rollers 40L and 40R. Switching pins 48, 54L and 54R are respectively inserted in the sleeves 44, 50L and 50R. The outer distal end of the change-over pin 54R protrudes beyond the side face of the second rocker arm 34R. The protruded distal end of the changeover pin 54R is in contact with a slide pin 58 of the change-over mechanism 10, which will be described later. On the other hand, the outer side of the sleeve 50L of the second rocker arm 34L is closed, and a return spring 56 is arranged inside the sleeve 50L. The return spring 56 presses the change-over pin 54L rightward in FIG. 2. By so doing, the changeover pins 54L, 48, and 54R are urged rightward in FIG. 2.

FIG. 2 shows a state where the first rocker arm 32 is separated from the second rocker arms 34L and 34R. In this separated state, the change-over pin 54L is engaged with only the sleeve 50L of the second rocker arm 34L, and is disengaged from the adjacent sleeve 44. In addition, the change-over pin 48 is engaged with only the sleeve 44 of the first rocker arm 32, and is disengaged from the adjacent sleeves 50L and 50R. Then, the change-over pin 54R is engaged with only the sleeve 50R of the second rocker arm 34R, and is disengaged from the adjacent sleeve 44. Therefore, even when the first rocker arm 32 rocks by the rotation of the primary cam 14, the rocking is not transmitted to the second rocker arm 34L or 34R. Then, the rollers 40L and 40R of the second rocker arms 34L and 34R are respectively in contact with the secondary cams 16 each having no cam nose. Therefore, even when the camshaft 4 rotates, the second rocker arms 34L and 34R do not rock, and the intake valves 12 remain stopped in a closed state.

In a state where the first rocker arm 32 is separated from the second rocker arms 34L and 34R, when the first roller 36 of the first rocker arm 32 is in contact with the base circle of the primary cam 14, the centers of the change-over pins 54L, 48 and 54R coincide with one another. At this time, when the change-over mechanism 10, which will be described later, is actuated to displace the slide pin 58 leftward in FIG. 2, the change-over pins 54L, 48 and 54R are moved leftward in FIG. 2 to thereby make it possible to switch the three arms 32, 34L and 34R into a coupled state.

In the coupled state, part of the change-over pin 48 is inserted in the sleeve 50L of the second rocker arm 34L, and part of the change-over pin 54R is inserted in the sleeve 44 of the first rocker arm 32. By so doing, the first rocker arm 32 is coupled to the second rocker arm 34L via the change-over pin 48, and the first rocker arm 32 is coupled to the second rocker arm 34R via the change-over pin 54R. Thus, as the first rocker aim 32 rocks by the rotation of the primary cam 14, the second rocker arms 34L and 34R also rock together, so the intake valves 12 open or close in synchronization with the rotation of the camshaft 4.

When the first rocker arm 32 and the second rocker arms 34L and 34R are released from the coupling, the change-over mechanism 10, which will be described later, is actuated to displace the slide pin 58 rightward in FIG. 2. Then, the change-over pins 54L, 48 and 54R are displaced rightward in FIG. 2 by the urging force of the return spring 56. As a result, it is possible to switch the three arms 32, 34L and 34R into the separated state shown in FIG. 2, that is, the intake valve stopped state.

Figure 3:
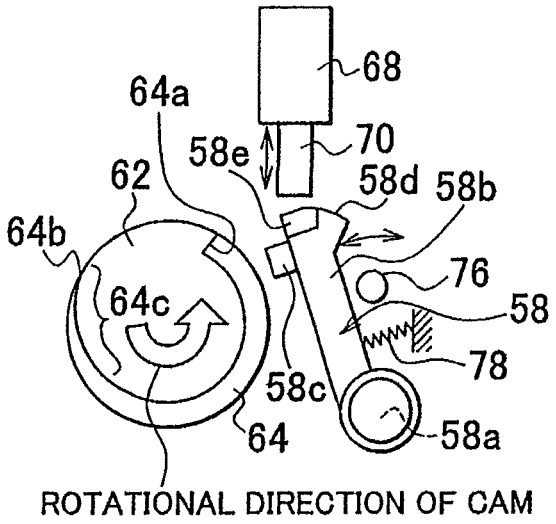
FIG. 3 is a view of the valve drive device shown in FIG. 1 as viewed in an axial direction (direction of the arrow B in FIG. 2) of a camshaft.
Figure 4:
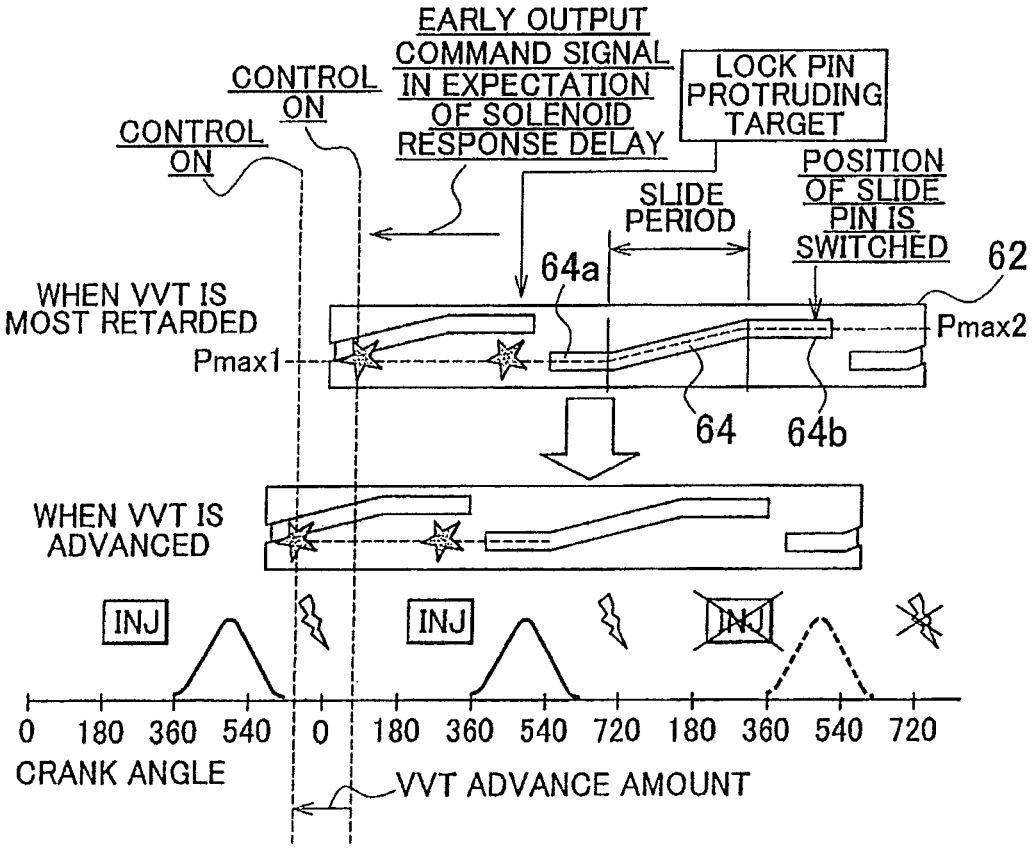
FIG. 4 is a view that shows the timing of solenoid control for stopping intake valves shown in FIG. 1 through a comparison of when a VVT is most retarded and when the VVT is advanced.

Next, the configuration of the change-over mechanism 10 will be described with reference to FIG. 2 to FIG. 4. FIG. 3 particularly shows the configuration of a spiral groove, which will be described later, with the end of the crankshaft 4 cut away for the sake of easy illustration. FIG. 4 shows an expansion plan of the spiral groove along the circumferential direction of the crankshaft 4.

The change-over mechanism 10 includes the slide pin 58 that is used to displace the change-over pins 48, 54L and 54R toward the side of the second rocker arm 34L. The slide pin 58 has a cylindrical portion 58*a* of which the end face is in contact with the end face of the change-over pin 54R. The cylindrical portion 58*a* is supported by a support member 60 fixed to a cam carrier so that the cylindrical portion 58*a* is movable in the axial direction and rotatable in the circumferential direction.

A columnar arm portion 58*b* is provided at the opposite end of the cylindrical portion 58*a* with respect to the change-over pin 54R so as to protrude radially outward of the cylindrical portion 58*a*. The distal end of the arm portion 58*b* extends to a location opposite the peripheral surface of the camshaft 4. The arm portion 58*b* is pivotable about the axis of the cylindrical portion 58*a* within the range limited by the camshaft 4 and a stopper 76. In addition, a spring 78 is attached to the arm portion 58*b*. The spring 78 urges the arm portion 58*b* toward the stopper 76.

A protruding portion 58*c* is provided at the distal end of the arm portion 58*b* so as to protrude toward the peripheral surface of the camshaft 4. A large-diameter portion 62 having a large outside diameter is formed on the outer peripheral surface of the camshaft 4, opposite the protruding portion 58*c*. A spiral groove 64 is formed on the peripheral surface of the large-diameter portion 62. The spiral groove 64 extends in the circumferential direction. The width of the spiral groove 64 is slightly larger than the outside diameter of the protruding portion 58*c*. A specific shape of the spiral groove 64 will be described later.

A device for inserting the protruding portion 58*c* into the spiral groove 64 is the above described actuator 66. More specifically, the actuator 66 includes the solenoid 68 and a lock pin 70. The solenoid 68 is duty-controlled by the ECU 26. The lock pin 70 is in contact with a drive shaft 68*a* of the solenoid 68. One end of a spring 72 is hooked on the lock pin 70. The spring 72 generates urging force against the thrust force of the solenoid 68. The other end of the spring 72 is hooked on a support member 74. The support member 74 is fixed to the cam carrier, which is a stationary member. The thrust force of the solenoid 68 overcomes the urging force of the spring 72 to thereby cause the lock pin 70 to protrude toward the slide pin 58.

A pressing surface 58*d* is provided at the distal end of the arm portion 58*b* of the slide pin 58. The protruded lock pin 70 contacts with the pressing surface 58*d*. The pressing surface 58*d* is pressed by the lock pin 70 to thereby press down the arm portion 58*b* toward the camshaft 4. At this time, when the camshaft 4 is located at an appropriate position, the protruding portion 58*c* is smoothly inserted into the spiral groove 64.

Here, Pmax1 denotes the position of the slide pin 58 at the time when the change-over pin 54L, is inserted in both the sleeve 50L and the sleeve 44 and the change-over pin 48 is inserted in both the sleeve 44 and the sleeve 50R by the urging force of the return spring 56. The position Pmax1 is indicated in FIG. 2 and FIG. 4. When the slide pin 58 is located at Pmax1, the first rocker arm 32 and the second rocker arms 34R and 34L all are in the coupled state. By achieving the coupled state, the intake valves 12 open or close in synchronization with the rotation of the camshaft 4.

Then, Pmax2 denotes the position of the slide pin 58 at the time when the change-over pin 48, or the like, receives force from the slide pin 58 and then the change-over pins 54L, 48 and 54R are respectively inserted only in the corresponding sleeves 50L, 44 and 50R. The position Pmax2 is indicated in FIG. 2 and FIG. 4. When the slide pin 58 is located at Pmax2, the first rocker arm 32 and the second rocker arms 34R and 34L all are in the separated state. By achieving the separated state, the second rocker arms 34L and 34R do not rock even when the camshaft 4 rotates, and the intake valves 12 remain stopped in a closed state.

The position of the proximal end 64*a* of the spiral groove 64 in the axial direction of the camshaft 4 is set so as to coincide with the position of the protruding portion 58*c* at the time when slide pin 58 is located at Pmax1. Then, the position of the terminal end 64*b* of the spiral groove 64 in the axial direction of the camshaft 4 is set so as to coincide with the position of the protruding portion 58*c* at the time when the slide pin 58 is located at Pmax2. That is, the slide pin 58 is configured to be displaceable between Pmax1 and Pmax2 within the range in which the protruding portion 58*c* is guided by the spiral groove 64. In other words, the orientation of the spiral of the spiral groove 64 of the camshaft 4 is set so that the slide pin 58 is displaced from Pmax1 to Pmax2 when the camshaft 4 rotates in a rotating direction in a state where the protruding portion 58*c* is inserted in the spiral groove 64.

Note that a shallow groove portion 64*c* is provided at the side of the terminal end 64*b* of the spiral groove 64. In the shallow groove portion 64*c*, the depth of the groove gradually gets shallower as it approaches the terminal end 64*b*. The protruding portion 58*c* is guided within the spiral groove 64 by the rotation of the camshaft 4, and escapes from the spiral groove 64 through the shallow groove portion 64*c*.

In addition, the arm portion 58*b* of the slide pin 58 has a cutout portion 58*e*. The cutout portion 58*e* is formed in a recessed shape by cutting out part of the pressing surface 58*d*. While the slide pin 58 is displaced from Pmax1 to Pmax2, the lock pin 70 is in contact with the pressing surface 58*d*. Then, when the slide pin 58 is displaced to Pmax2 and then the protruding portion 58*c* escapes from the spiral groove 64 by the function of the shallow groove portion 64*c*, the lock pin 70 is engaged with the cutout portion 58*e*. The lock pin 70 is engaged with the cutout portion 58*e* to thereby restrict rotation of the arm portion 58*b* in a direction in which the protruding portion 58*c* is inserted into the spiral groove 64 while holding the position of the slide pin 58 at Pmax2.

As is apparent from the above description, in the present embodiment, the spiral groove 64 corresponds to "a guide passage that is restricted from rotating with respect to a camshaft". In addition, the protruding portion 58*c* corresponds to "a guided member that is able to be engaged with or disengaged from the guide passage". The slide pin 58 corresponds to "an operating member that is displaced in an axial direction of the camshaft through a relative displacement in the axial direction between the guide passage and the guided member, the relative displacement being caused by the rotation of the camshaft". Then, the intake valve stop mechanism 8 corresponds to "a valve operating characteristic changing mechanism that changes operating characteristics of a valve with respect to the rotation of the camshaft through a displacement of the operating member".

Next, the operation of the thus configured valve drive device 2 according to the present embodiment will be described. The operation of the valve drive device 2 according to the present embodiment is controlled by the ECU 26. The ECU 26 switches between the on state and off state of the solenoid 68 to change the operating characteristics of the intake valves 12. Specifically, while the intake valves 12 are operating, the solenoid 68 is off, and the slide pin 58 is located at Pmax1. In this state, when the solenoid 68 is switched from the off state to the on state, the arm portion 58*b* of the slide pin 58 is pressed down by the protrusion of the lock pin 70, and then the protruding portion 58*c* at the distal end of the arm portion 58*b* is inserted into the spiral groove 64. As the camshaft 4 rotates, the protruding portion 58*c* is guided in the axial direction of the camshaft 4 by the spiral groove 64, and the slide pin 58 moves from Pmax1 to Pmax2. By so doing, the first rocker arm 32 and the second rocker arms 34R and 34L all are in the separated state, the rotation of the camshaft 4 is not transmitted to the intake valves 12, and then the intake valves 12 stop in a closed state.

The protruding portion 58*c* finally escapes from the spiral groove 64 by the rotation of the camshaft 4. However, the lock pin 70 is engaged with the cutout portion 58*e* to hold the slide pin 58 at the position Pmax2, so the intake valves 12 remain stopped.

In this state, now, when the solenoid 68 is switched from the on state to the off state, the lock pin 70 retracts, so the lock pin 70 is disengaged from the cutout portion 58*e*. The slide pin 58 is pushed back by the return spring 56 together with the change-over pins 54L, 48 and 54R, and the slide pin 58 moves from Pmax2 to Pmax1. By so doing, the first rocker arm 32 and the second rocker arms 34R and 34L are in the coupled state, the rotation of the camshaft 4 is transmitted to the intake valves 12 again, and then the intake valves 12 return from the stopped state.

In order to implement the above operation, the timing of on/off control of the solenoid 68 is important. Because the camshaft 4 is rotating, the position, at which the protruding portion 58*c* lands in the spiral groove 64, varies depending on the timing at which the solenoid 68 is turned on. Therefore, when the solenoid 68 cannot be turned on at an appropriate timing, there is a concern that the protruding portion 58*c* does not enter the spiral groove 64 and then stop of the intake valves 12 delays one cycle. In addition, there is another concern that the spiral groove 64 or the protruding portion 58*c* wears or the slide pin 58 is damaged. On the other hand, when the timing at which the solenoid 68 is turned off is not appropriate, that timing does not match the timing at which the positions of the change-over pins 54L, 48 and 54R coincide with one another, so there is a concern that switching from the valve stopped state to the valve operated state delays one cycle.

The signal from the crank position sensor 28 may be used as a signal for determining the timing at which the solenoid 68 is turned on or off. With the signal of the crank position sensor 28, it is possible to precisely measure a crank angle in 10 degrees. However, the variable valve timing mechanism 6 is provided for the valve drive system according to the present embodiment. When the rotational phase difference of the camshaft 4 with respect to the crankshaft is varied by the variable valve timing mechanism 6, the crank angle at which the solenoid 68 should be turned on or off also varies.

FIG. 4 shows the timing of solenoid control for stopping the intake valves 12 in crank angle and in position with respect to the spiral groove 64. FIG. 4 shows a desirable timing at which the solenoid 68 is turned on through a comparison of when the variable valve timing mechanism (VVT) 6 is most retarded and when the VVT 6 is advanced. There is a response delay from when the solenoid 68 is turned on to when the lock pin 70 protrudes, so the ECU 26 early outputs a command (control ON command) to the solenoid 68 in expectation of the response delay. As shown in the drawing, when the variable valve timing mechanism 6 is advanced, the rotational phase of the camshaft 4 with respect to the crankshaft is also advanced, so it is necessary to also advance the timing at which the solenoid 68 is turned on depending on the amount of advance.

Figure 5:
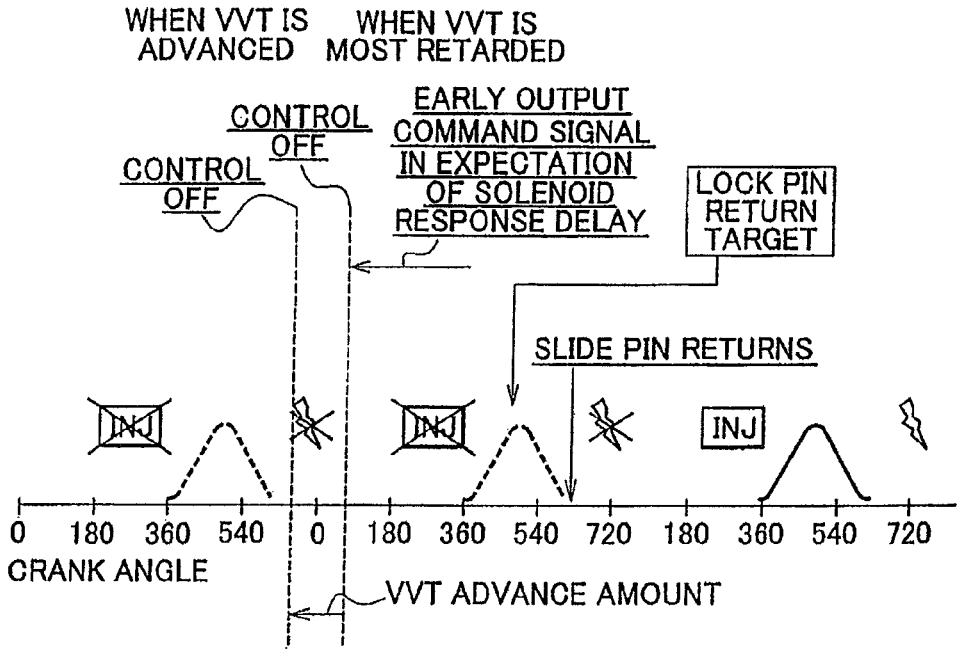
FIG. 5 is a view that shows the timing of solenoid control for returning the intake valves shown in FIG. 1 from a stopped state through a comparison of when the VVT is most retarded and when the VVT is advanced.

FIG. 5 shows the timing of solenoid control for returning the intake valves 12 from the stopped state in crank angle. FIG. 5 shows a desirable timing at which the solenoid 68 is turned off through a comparison of when the variable valve timing mechanism (VVT) 6 is most retarded and when the VVT 6 is advanced. There is a response delay from when the solenoid 68 is turned off to when the lock pin 70 returns, so the ECU 26 early outputs a command (control off command) to the solenoid 68 in expectation of the response delay. As shown in the drawing, when the variable valve timing mechanism 6 is advanced, the rotational phase of the camshaft 4 with respect to the crankshaft is also advanced, so it is necessary to also advance the timing at which the solenoid 68 is turned off depending on the amount of advance.

Note that, in the bottom of FIG. 4 and FIG. 5, the lift curve of each intake valve 12, INJ mark that indicates fuel injection timing and lightening-shaped mark that indicates ignition timing are shown in correspondence with crank angles. The lift curve indicated by dotted line means that the intake valves 12 are stopped in a closed state, and cross marks assigned to the marks that indicate fuel injection timing and ignition timing mean that the fuel injection or ignition is not carried out.

The general description of solenoid control executed in the present embodiment is described above, and the detailed description thereof will now be described with reference to the flowchart.

Figure 6:
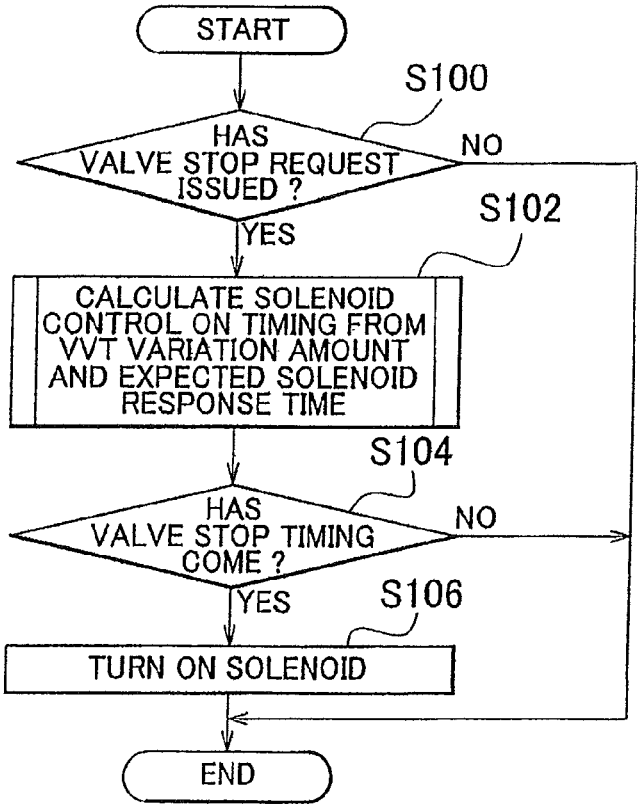
FIG. 6 is a flowchart that shows the routine of solenoid control executed when the intake valves are stopped according to the first embodiment of the invention.

The flowchart of FIG. 6 shows the routine of solenoid control when the intake valves 12 are stopped. In the first step S100, it is determined whether a stop request for the intake valves 12 has been issued. When no stop request for the intake valves 12 has been issued, the routine ends.

When a stop request for the intake valves 12 has been issued, the process of step S102 is executed. In step S102, the following mathematical expression (1) is used to calculate the timing at which a command signal is output from the ECU 26 to the solenoid 68, that is, the control on timing of the solenoid.

$$INSTPCRK(CA)=INSTPCRKB(CA)+VT(CA)INSTPRPLYDLY(ms)\times NE(rpm)\times KEISU \quad (1)$$

In the mathematical expression (1), respective strings are defined as follows. Note that CA, ms and rpm inside the parentheses indicate units.

INSTPCRK: a crank angle at which the solenoid is energized (control on timing of the solenoid)

INSTPCRKB: a base value of a crank angle at which the solenoid is energized (which is set to match a position at which the variable valve timing mechanism is most retarded)

INSTPRPLYDLY: a response delay time from when the solenoid has been energized

NE: a rotational speed of the crankshaft

KEISU: a crank conversion factor

VT: an amount of advance of the variable valve timing mechanism

As is apparent from the mathematical expression (1), the timing at which the command signal is output from the ECU 26 to the solenoid 68 is measured from the rotational position (crank angle) of the crankshaft; however, the output timing is corrected on the basis of an amount of advance of the variable valve timing mechanism 6, that is, the rotational phase difference of the camshaft 4 with respect to the crankshaft. Furthermore, the output timing is corrected on the basis of a response delay time of the solenoid 68 for the command signal (control on signal) and a rotational speed, of the crankshaft.

In the next step S104, it is determined whether the timing calculated in step S102 has come. The timing is determined on the basis of the signal from the crank position sensor 28. When the timing has not yet come, the routine directly ends. Then, when the timing calculated in step S102 has come, the process proceeds to step S106, and the command signal (control on signal) is output from the ECU 26 to the solenoid 68.

The above routine is executed by the ECU 26 to thereby make it possible to insert the protruding portion 58*c* of the slide pin 58 into the spiral groove 64 at an appropriate timing even when the variable valve timing mechanism 6 is actuated to change the rotational phase difference of the camshaft 4. with respect to the crankshaft. Thus, it is possible to smoothly switch from the operated state of the intake valves 12 into the valve stopped state.

Figure 7:
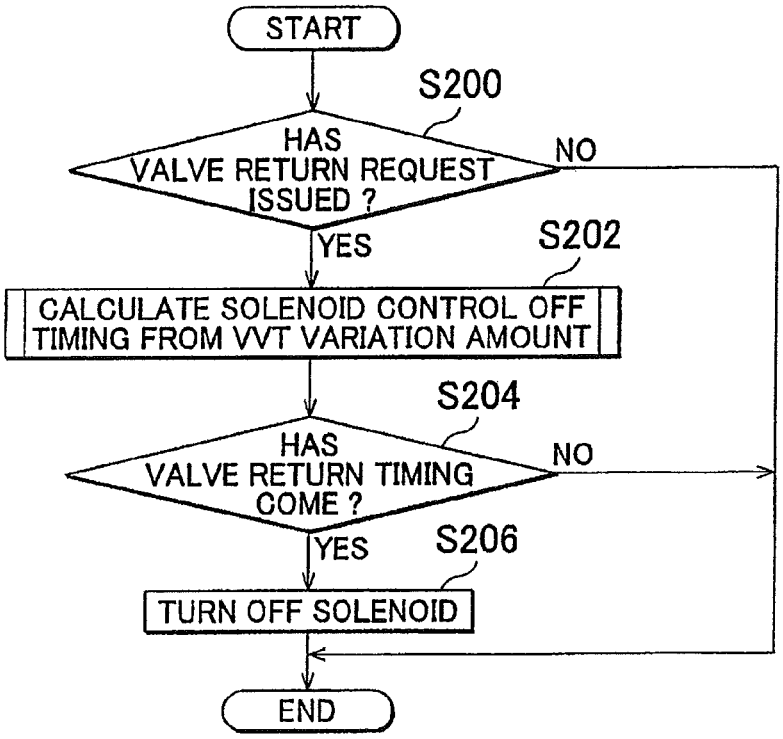
FIG. 7 is a flowchart that shows the routine of solenoid control executed when the intake valves are returned according to the first embodiment of the invention.

The flowchart of FIG. 7 shows the routine of solenoid control when the intake valves 12 are returned from the stopped state. In the first step S200, it is determined whether a request for the intake valves 12 to return from the stopped state has been issued. When no return request for the intake valves 12 has been issued, the routine ends.

When a return request for the intake valves 12 has been issued, the process of step S202 is executed. In step S202, the following mathematical expression (2) is used to calculate the timing at which the command signal is output from the ECU 26 to the solenoid 68, that is, the timing at which solenoid control is turned off.

$$INMVCRK(CA)=INMVCRKB(CA)+VT(CA)+INMVRPLYDLY(ms)\times NE(rpm)\times KEISU \quad (2)$$

In the above mathematical expression (2), respective strings are defined as follows. Note that NE, KEISU and VT are defined as in the case of the mathematical. expression (1).

INMVCRK: a crank angle at which the solenoid is de-energized (timing at which solenoid control is turned off)

INMVCRKB: a base value of a crank angle at which the solenoid is de-energized (which is set at a position at which the variable valve timing mechanism is most retarded)

INMVRPLYDLY: a response delay time from when the solenoid has been de-energized

In the next step S104, it is determined whether the timing calculated in step S202 has come. The timing is determined on the basis of the signal from the crank position sensor 28. When the timing has not yet come, the routine directly ends. Then, when the timing calculated in step S202 has come, the process proceeds to step S206, and the command signal (control off signal) is output from the ECU 26 to the solenoid 68.

The above routine is executed by the ECU 26 to thereby make it possible to release engagement between the lock pin 70 and the cutout portion 58*e* at an appropriate timing even when the variable valve timing mechanism 6 is actuated to change the rotational phase difference of the camshaft 4 with respect to the crankshaft. Thus, it is possible to smoothly switch from the stopped state of the intake valves 12 into the operated state.

In the present embodiment, the aspect of the invention is applied to the intake valve drive system; however, the above described technique may also be applied to an exhaust valve drive system. That is, as long as an exhaust-side camshaft is provided with a variable valve timing mechanism and, in addition, a valve drive device for exhaust valves includes an exhaust valve stop mechanism and a change-over mechanism, it is only necessary that a solenoid of the change-over mechanism is controlled in accordance with the above described method. However, contrary to the intake variable valve timing mechanism that is controlled with reference to a most retarded position, the exhaust variable valve timing mechanism is controlled with reference to a most advanced position. Thus, when the above described solenoid control method is applied to the exhaust side, the base value of a crank angle at which the solenoid is energized and the base value of a crank angle at which the solenoid is de-energized are set to match the most advanced position of the variable valve timing mechanism, and the correction amounts need to be an amount of retardation of the variable valve timing mechanism.

Specifically, when the exhaust valves are stopped, it is only necessary that the following mathematical expression (3) is used to calculate the timing at which the command signal is output from the ECU to the solenoid, that is, the control on timing of the solenoid.

$$EXSTPCRK(CA)=EXSTPCRKB(CA)+EXVT(CA)+EXSTPRPLYDLY(ms)\times NE(rpm)\times KEISU \quad (3)$$

In the above mathematical expression (3), respective strings are defined as follows. Note that NE and KEISU are defined as in the case of the mathematical expression (1).

EXSTPCRK: a crank angle at which the solenoid is energized (control on timing of the exhaust-side solenoid)

EXSTPCRKB: a base value of a crank angle at which the solenoid is energized (which is set to match a most advanced position of the exhaust variable valve timing mechanism)

EXSTPRPLYDLY: a response delay time from when the solenoid has been energized

EXVT: an amount of retardation of the exhaust variable valve timing mechanism

Next, a second embodiment of the invention will be described. The present embodiment differs from the first embodiment in solenoid control at the time when the intake valves 12 are stopped. In the present embodiment, in the process of step S102 of the routine shown in FIG. 6, instead of the above mathematical expression (1), the following mathematical expression (4) is used to calculate the control on timing of the solenoid.

$$\text{INSTPCRK(CA)}=\text{INSTPCRKB(CA)}+\text{VT(CA)}+\text{GVTFR(CA)}+\text{INSTPRPLYDLY(ms)}\times\text{NE(rpm)}\times\text{KEISU} \quad (4)$$

In the above mathematical expression (4), INSTPCRK, INSTPCRKB, INSTPRPLYDLY, NE, KEISU and VT are defined as in the case of the mathematical expression (1). A new string GVTFR is defined as follows.

GVTFR: a learned value of a VVT most retarded position

As is apparent from the above mathematical expression (4), in the present embodiment, the learned value GVTFR of the VVT most retarded position, that is, the most retarded position of the variable valve timing mechanism 6, is used to correct the base value INSTPCRKB of a crank angle at which the solenoid 68 is energized. The most retarded position of the variable valve timing mechanism 6 may deviate because of aging. The above deviation is in a public domain, and various methods for learning the deviation are known. With the above mathematical expression (4), the control on timing of the solenoid reflects the learned value, for which a deviation of the VVT most retarded position is learned, to thereby make it possible to insert the protruding portion 58*c* of the slide pin 58 into the spiral groove 64 constantly at an appropriate timing without receiving any influence of aging.

Note that the technical feature newly added in the present embodiment may be applied to solenoid control at the time when the intake valves 12 are returned from a stopped state. Specifically, it is only necessary that, in the flowchart shown in FIG. 7, the term of the learned value GVTFR of the VVT most retarded position is added to the right-hand side of the mathematical expression (2) used in the process of step S204. By so doing, it is possible to release engagement between the lock pin 70 and the cutout portion 58*e* constantly at an appropriate timing without receiving any influence of aging.

Next, a third embodiment of the invention will be described. The present embodiment differs from the first embodiment in solenoid control at the time when the intake valves 12 are stopped. In the present embodiment, in the process of step S102 of the routine shown in FIG. 6, instead of the above mathematical expression (1), the following mathematical expression (5) is used to calculate the control on timing of the solenoid.

$$\text{INSTPCRK(CA)}=\text{INSTPCRKB(CA)}+\text{VT(CA)}+\text{GVTFR(CA)}+\text{INSTPRPLYDLY(ms)}\times\text{NE(rpm)}\times\text{KEISU}+\text{DLVT}\times\text{KP} \quad (5)$$

In the above mathematical expression (5), INSTPCRK, INSTPCRKB, INSTPRPLYDLY, NE, KEISU, VT and GVTFR are defined as in the case of the mathematical expression (3). New strings DLVT and KP are defined as follows.

DLVT: VVT rate

KP: VVT gain

In the above mathematical expression (5), the term of DLVT×KP means a predicted variation in amount of advance VT of the variable valve timing mechanism 6, that is, a predicted variation in rotational phase difference of the camshaft 4 with respect to the crankshaft. The predicted variation occurs by the time the solenoid 68 is actually actuated to cause the protruding portion 58*c* of the slide pin 58 to be inserted into the spiral groove 64 from the time at which the mathematical expression (5) is calculated. The VVT rate may be obtained by processing the signal of the cam position sensor 29.

The intake valves 12 may be switched from the stopped state into the operated state during operation of the variable valve timing mechanism 6. In this case, by the time the solenoid 68 is actuated to cause the protruding portion 58*c* of the slide pin 58 to be inserted into the spiral groove 64, the rotational phase difference of the camshaft 4 with respect to the crankshaft further varies. With the above mathematical expression (5), the control on timing of the solenoid reflects the predicted variation (DLVT×KP) in the amount of advance VT to thereby make it possible to insert the protruding portion 58*c* of the slide pin 58 into the spiral groove 64 at an appropriate timing even during operation of the variable valve timing mechanism 6.

Note that the technical feature newly added in the present embodiment may be applied to solenoid control at the time when the intake valves 12 are returned from a stopped state. Specifically, it is only necessary that, in the flowchart shown in FIG. 7, the term of the predicted variation (DLVT×KP) in the amount of advance VT is added to the right-hand side of the mathematical expression (2) used in the process of step S204. By so doing, even during operation of the variable valve timing mechanism 6, it is possible to release engagement between the lock pin 70 and the cutout portion 58*e* at an appropriate timing.

Figure 8:
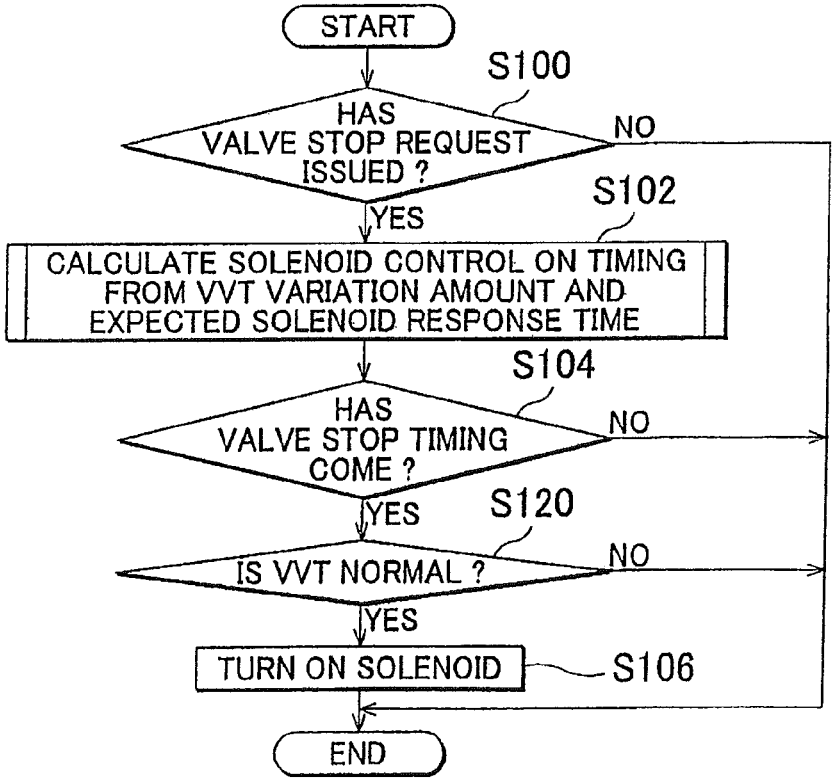
FIG. 8 is a flowchart that shows the routine of solenoid control executed when the intake valves are stopped according to a fourth embodiment of the invention.

Next, a fourth embodiment of the invention will be described with reference to FIG. 8. The present embodiment differs from the first embodiment in solenoid control at the time when the intake valves 12 are stopped. In the present embodiment, instead of the routine shown in the flowchart of FIG. 6, the routine shown in the flowchart of FIG. 8 is executed by the ECU 26. Among the processes shown in the flowchart of FIG. 8, the processes common to those of the first embodiment are assigned with the same step numbers as those of the first embodiment. Hereinafter, the description of the processes common to those of the first embodiment is omitted or simplified, and the processes different from those of the first embodiment will be specifically described.

In the flowchart of FIG. 8, the processes of step S100 to step S104 are common to those of the first embodiment. The difference from the first embodiment is that, when affirmative determination is made in step S104, determination of step S120 is further carried out. Then, only when affirmative determination is made in step S120, the process proceeds to step S106; whereas, when negative determination is made in step S120, the routine ends.

In step S120, it is determined whether the variable valve timing mechanism 6 is not abnormal (whether the variable valve timing mechanism 6 is normal). The case where the variable valve timing mechanism 6 is abnormal, for example, includes the case where foreign matter is entrapped in a movable portion or the case where inching control at a low oil temperature is carried out. When entrapment of foreign matter is detected or when inching control is carried out, a corresponding flag is set. Therefore, when any one of those flags is set, it is determined that the variable valve timing mechanism 6 is abnormal.

With the above routine, when the variable valve timing mechanism 6 cannot normally operate (the variable valve timing mechanism 6 is abnormal), output of the command signal (control on signal) from the ECU 26 to the solenoid 68 is prohibited. Thus, it is possible to prevent the protruding portion 58*c* of the slide pin 58 from protruding into the spiral groove 64 at a wrong timing.

Note that the technical feature newly added in the present embodiment may be applied to solenoid control at the time when the intake valves 12 are returned from a stopped state. Specifically, it is only necessary that, in the flowchart of FIG. 7, the same determination as that of step S120 is carried out before the process of step S206, and the process proceeds to step S206 only when the determination is affirmative; whereas the routine ends when the determination is negative. By so doing, it is possible to prevent releasing of engagement between the lock pin 70 and the cutout portion 58*e* at a wrong timing.

Figure 9:
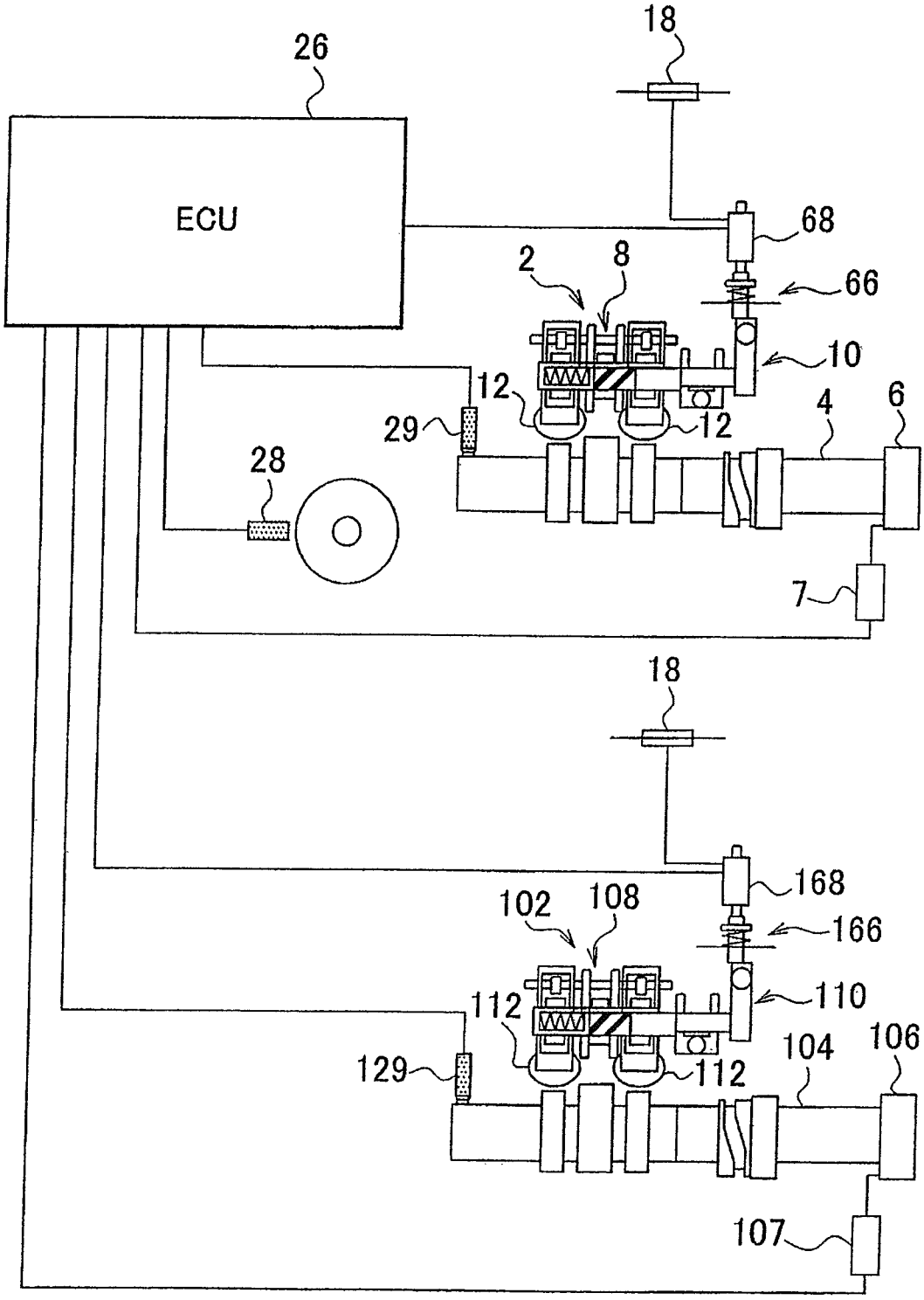
FIG. 9 is a schematic view that shows the overall configuration of a controller for an internal combustion engine according to a fifth embodiment of the invention.

Next, a fifth embodiment of the invention will be described with reference to FIG. 9 to FIG. 11. FIG. 9 is a schematic view that shows the overall configuration of a controller for an internal combustion engine according to the fifth embodiment of the invention. A valve drive system shown in the drawing is used for intake valves 12 and exhaust valves 112. Two intake valves 12 are provided for each cylinder, and are driven by a common valve drive device 2. Similarly, two exhaust valves 112 are provided for each cylinder, and are driven by a common valve drive device 102. Note that, in FIG. 9, like reference numerals denote components similar to those of the first embodiment among various components that constitute the controller.

In the present embodiment, variable valve timing mechanisms 6 and 106 are respectively provided for an intake-side camshaft 4 and an exhaust-side camshaft 104. Both the variable valve timing mechanisms 6 and 106 are of a hydraulic type, and hydraulic pressures of the variable valve timing mechanisms 6 and 106 are respectively controlled by hydraulic pressure control valves 7 and 107.

The intake valve drive device 2, as well as that of the first embodiment, includes an intake valve stop mechanism 8 and a change-over mechanism 10. Similarly, the exhaust valve drive device 102 includes an exhaust valve stop mechanism 108 and a change-over mechanism 110. The exhaust valve stop mechanism 108 stops the exhaust valves 112 in a closed state. The change-over mechanism 110 drives the exhaust valve stop mechanism 108 to change the operating characteristics of the exhaust valves 112. The structure of the exhaust valve stop mechanism 108 is similar to the structure of the intake valve stop mechanism 8, and the structure of the change-over mechanism 110 is similar to the structure of the change-over mechanism 10. The intake-side change-over mechanism 10 and the exhaust-side change-over mechanism 110 are respectively provided with actuators 66 and 166, and respectively use solenoids 68 and 168 as drive devices. In addition, a common 12-V power supply 18 of a vehicle is used as a power supply for driving the solenoids 68 and 168.

The valve drive device according to the present embodiment is formed of the above described various mechanisms and an electronic control unit (ECU) 26. The ECU 26 controls the hydraulic pressure control valves 7 and 107 to thereby control the operations of the variable valve timing mechanisms 6 and 106, and controls the solenoids 68 and 168 to thereby control the operations of the change-over mechanisms 10 and 110. In the present embodiment, cooperative control between the two solenoids 68 and 168 is particularly important. The ECU 26 controls the two solenoids 68 and 168 on the basis of a signal from the crank position sensor 28 and signals from cam position sensors 29 and 129 attached to the respective camshafts 4 and 104.

The valve drive device according to the present embodiment is configured to be able to stop not only the intake valves 12 but also the exhaust valves 112 in a closed state. The thus configured valve control may stop only one set of the intake valves 12 and the exhaust valves 112 or may also stop both the intake valves 12 and the exhaust valves 112. In the former case, solenoid control is executed by the methods described in the above embodiments to thereby make it possible to smoothly change the operating state of the intake valves 12 or the operating state of the exhaust valves 112. On the other hand, in the latter case, cooperative control is required between the intake-side solenoid 68 and the exhaust-side solenoid 168 because of the following reason.

For example, it is assumed that the exhaust valves 112 are stopped in the exhaust stroke of a cycle and the intake valves 12 are stopped in the intake stroke of the next cycle. In this case, the exhaust-side (EX) solenoid 168 is switched from the off state to the on state, and, subsequently, the intake-side (IN) solenoid 68 is switched from the off state to the on state. FIG. 10 is a timing chart that shows variations in duties applied to the respective solenoids 68 and 168 in that case. As shown in FIG. 10, when the valves 12 and 112 are stopped, supply of large current (duty 100%) is required for a certain period of time immediately after the solenoids 68 and 168 are switched from the off state to the on state. Currents for duty-controlling the solenoids 68 and 168 are supplied from the ECU 26, so the load on the ECU 26 increases.

Figure 10:
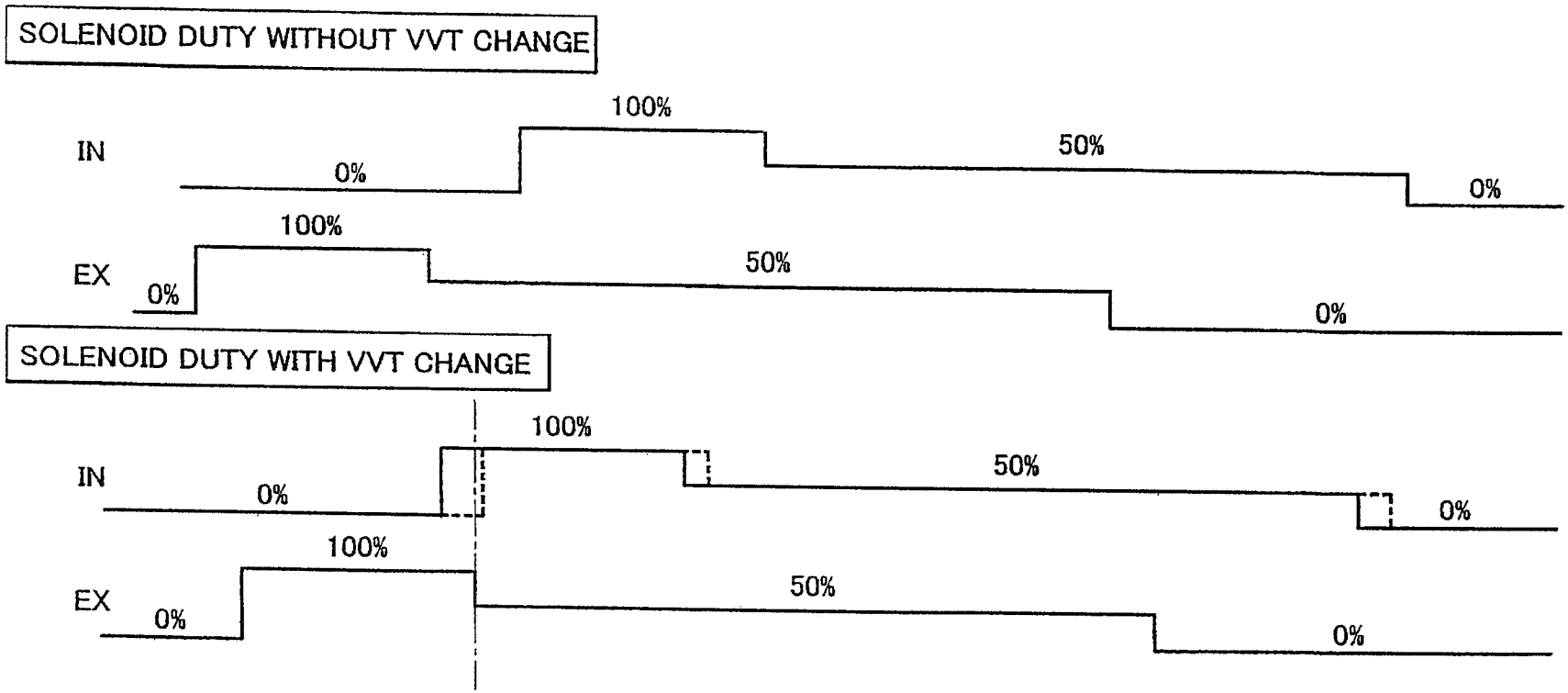
FIG. 10 is a timing chart that shows solenoid control executed when both intake and exhaust valves are stopped through a comparison of when there is no VVT change and when there is a VVT change according to the fifth embodiment of the invention.
Figure 11:
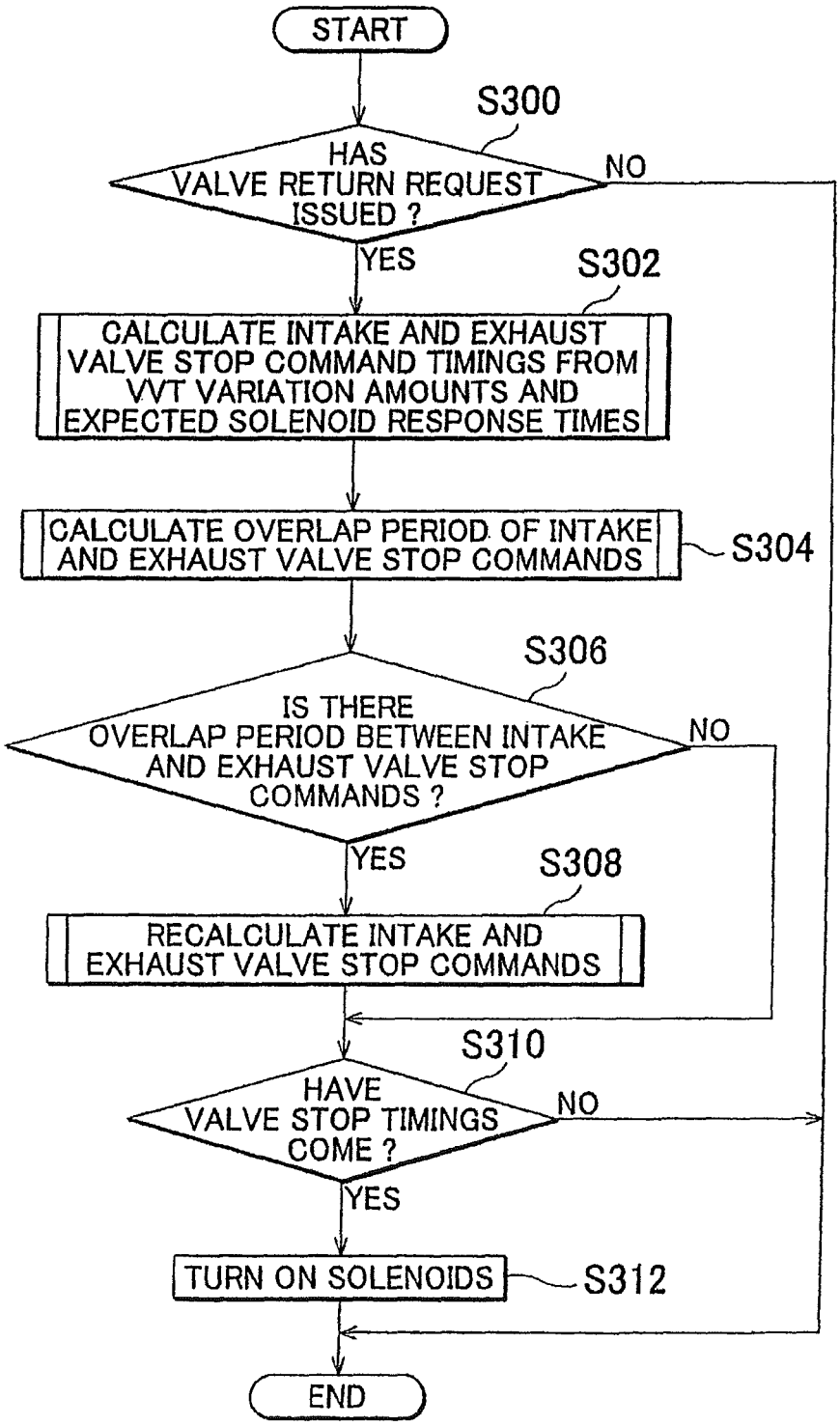
FIG. 11 is a flowchart that shows the routine of solenoid control executed when both intake and exhaust valves are stopped according to the fifth embodiment of the invention.

The upper row of FIG. 10 indicates variations in duties of the respective solenoids 68 and 168, which output when the intake variable valve timing mechanism 6 is located at a most retarded position that is the reference position and the exhaust variable valve timing mechanism 106 is located at a most advanced position that is the reference position. In this case, an intake-side (IN) duty 100% interval does not overlap an exhaust-side (EX) duty 100% interval. However, when the control on timing of the solenoid is corrected for each of the intake side and the exhaust side through solenoid control described in the above embodiments, there is a possibility that both the duty 100% intervals overlap each other. This is because the control on timing of the intake-side solenoid is corrected to advance and the control on timing of the exhaust-side solenoid is corrected to retard. The lower row of FIG. 10 exactly shows this case.

When both duty 100% intervals overlap each other, the ECU 26 is placed under an excessive load. In that case as well, a damage to the ECU 26 may be prevented by taking appropriate overcurrent protection measures on the hardware; however, this increases cost by that much. Then, in the present embodiment, as indicated by broken lines in the lower row of FIG. 10, the control on timing of the intake-side solenoid is adjusted so that the duty 100% intervals of the intake side and exhaust side do not overlap each other.

The general description of solenoid control executed in the present embodiment is described above, and the detailed description thereof will be described with reference to the flowchart. The flowchart of FIG. 11 shows the routine of solenoid control at the time when the intake valves 12 and the exhaust valves 112 are stopped. In the first step S300, it is determined whether a stop request for both valves has been issued. When no stop request for both valves has been issued, the routine ends. Note that, when a stop request for only one set of the intake valves 12 and the exhaust valves 112 has been issued, solenoid control is executed by the methods described in the above embodiments.

When a stop request for both valves has been issued, the process of step S302 is executed. In step S302, the above mathematical expression (1) is used to calculate the timing at which the command signal is output from the ECU 26 to the intake-side solenoid 68, that is, a crank angle INSTPCRK at which the intake-side solenoid 68 is energized. In addition, the above mathematical expression (3) is used to calculate the timing at which the command signal is output from the ECU 26 to the exhaust-side solenoid 168, that is, a crank angle EXSTPCRK at which the exhaust-side solenoid 168 is energized.

In the next step S304, an overlap period in which both duty 100% intervals overlap each other is calculated using the following mathematical expressions (6) and (7) on the basis of the crank angle INSTPCRK, at which the intake-side solenoid 68 is energized and which is calculated in step S302, and the crank angle EXSTPCRK at which the exhaust-side solenoid 168 is energized.

$$EXDUTY100END(CA)=EXSTPCRK(CA)+EXDUTY100WIDTH(CA) \quad (6)$$

$$OVRP(CA)=INSTPCRK(CA)-EXDUTY100END(CA) \quad (7)$$

EXDUTY100WIDTH in the above mathematical expression (6) is a duration during which the duty of the exhaust-side solenoid 168 is 100%. Then, OVRP in the above mathematical expression (7) is a duty 100% overlap period between the intake-side solenoid 68 and the exhaust-side solenoid 168.

Next, in step S306, it is determined whether there is a duty 100% overlap period on the basis of the result of calculation in step S304. When the value of the calculated overlap period OVRP is positive, it means that there is an overlap period; whereas, when the value of the overlap period OVRP is negative, it means that there is no overlap period.

When negative determination is made in step S306, the process directly proceeds to step S310. On the other hand, when affirmative determination is made in step S306, the process of step S308 is executed and then the process proceeds to step S310. In step S308, the following mathematical expression (8) is used to recalculate a crank angle INSTPCRK at which the intake-side solenoid 68 is energized.

$$INSTPCRK(CA)-INSTPCRK(CA)+OVRP(CA) \quad (8)$$

As is apparent from the above mathematical expression (8), when the duty 100% intervals of the intake side and exhaust side overlap each other, the crank angle INSTPCRK at which the intake-side solenoid 68 is energized is corrected to retard by the overlap period OVRP.

In step S310, it is determined whether the timing calculated in step S302 or the timing recalculated in step S308 has come. When the calculated or recalculated timing has not yet come, the routine directly ends. Then, when the timing has come in each of the intake side and the exhaust side, the process proceeds to step S312, and then the command signals (control on signals) are output from the ECU 26 to the solenoids 68 and 168.

The above routine is executed by the ECU 26 to adjust the timings, at which the command signals are output to the intake side and the exhaust side, so as to cancel the overlap between the timings at which the command signals are output to the intake-side and the exhaust-side solenoids when there is the overlap. Thus, it is possible to prevent an excessive load from being exerted on the ECU 26.

Note that, in step S308, instead of recalculating a crank angle INSTPCRK at which the intake-side solenoid 68 is energized, a crank angle EXSTPCRK at which the exhaust-side solenoid 168 is energized may be recalculated. Specifically, as shown in the following mathematical expression (9), a crank angle EXSTPCRK at which the exhaust-side solenoid 168 is energized may be advanced by an overlap period OVRP.

$$EXSTPCRK(CA)=EXSTPCRK(CA)-OVRP(CA) \quad (9)$$

Alternatively, it is also applicable that a crank angle INSTPCRK at which the intake-side solenoid 68 is energized is corrected to retard by X % of the overlap period OVRP and a crank angle EXSTPCRK at which the exhaust-side solenoid 168 is energized is corrected to advance by (100−X)% of the overlap period OVRP.

Figure 12:
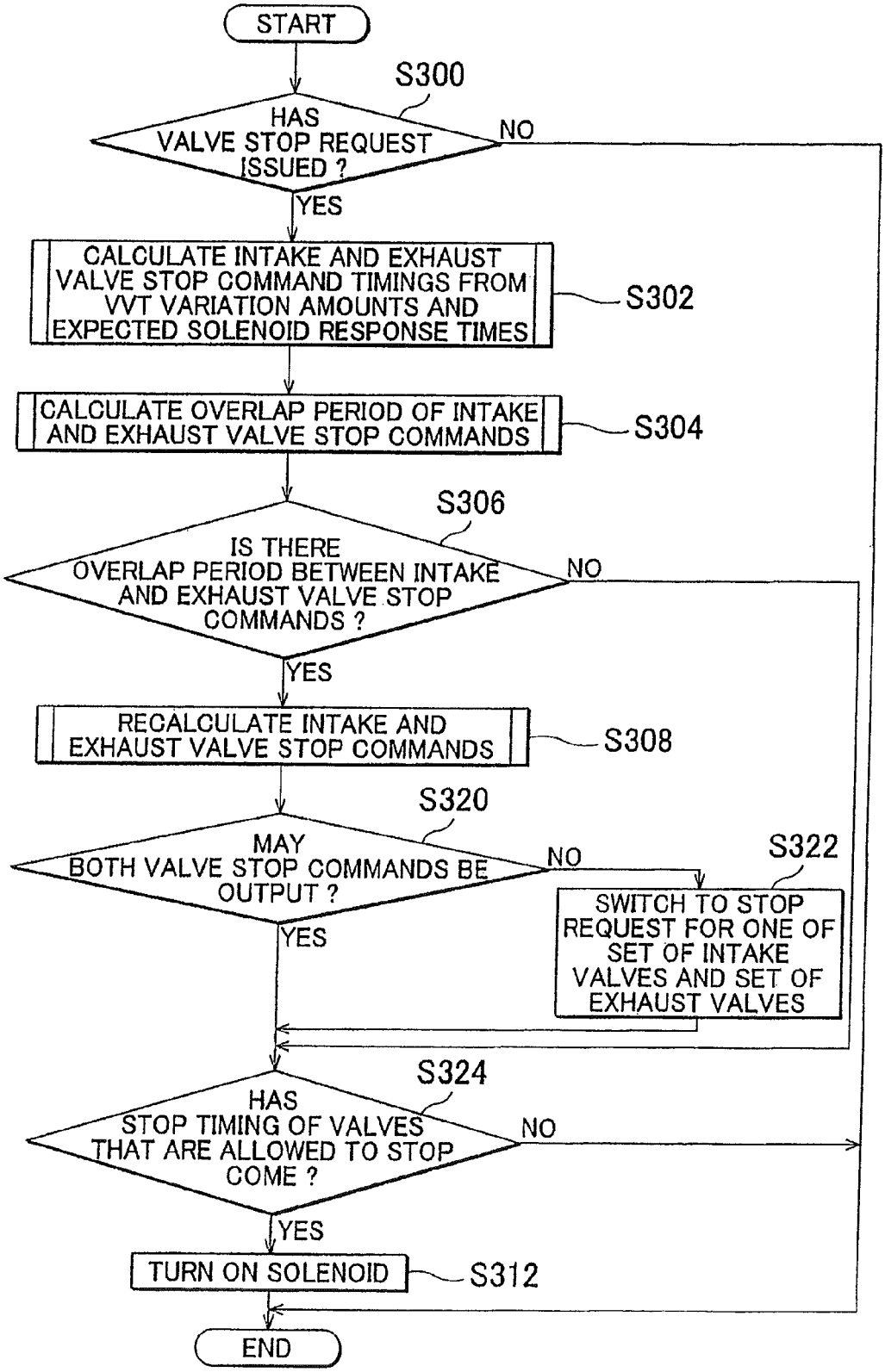
FIG. 12 is a flowchart that shows the routine of solenoid control executed when both intake and exhaust valves are stopped according to a sixth embodiment of the invention.

Next, a sixth embodiment of the invention will be described with reference to FIG. 12. The present embodiment differs from the fifth embodiment in solenoid control at the time when the intake valves 12 and the exhaust valves 112 both are stopped. In the present embodiment, instead of the routine shown in the flowchart of FIG. 11, the routine shown in the flowchart of FIG. 12 is executed by the ECU 26. Among the processes shown in the flowchart of FIG. 12, the processes common to those of the fifth embodiment are assigned with the same step numbers as those of the fifth embodiment. Hereinafter, the description of the processes common to those of the fifth embodiment is omitted or simplified, and the processes different from those of the fifth embodiment will be specifically described.

In the flowchart of FIG. 12, the processes of step S300 to step S308 are common to those of the fifth embodiment. The difference from the fifth embodiment is that determination of step S320 is carried out after the process of step S308, the process of step S322 is executed where necessary depending on the determination result, and determination of step S324 is carried out instead of determination of step S310.

In step S320, it is determined whether it is actually possible to output the crank angle INSTPCRK, at which the intake-side solenoid 68 is energized and which is recalculated in step S308, to the intake-side solenoid 68 or output the crank angle EXSTPCRK, at which the exhaust-side solenoid 168 is energized and which is recalculated in step S308, to the exhaust-side solenoid 168. This is because, depending on the timing at which the intake valves 12 or the exhaust valves 12 are stopped, there is a possibility that the stop timing of the intake valves 12 or exhaust valves 112 with respect to a crank angle is inappropriate and then operation of the internal combustion engine has some trouble. When the crank angles, at which the solenoids 68 and 168 are energized and which are recalculated in step S308, may be output to the respective solenoids 68 and 168, the process proceeds to step S324; whereas, when the crank angles, at which the solenoids 68 and 168 are energized, may not be output to the respective solenoids 68 and 168, the process proceeds to step S322.

In step S322, it is determined not to stop the intake valves 12 and the exhaust valves 112 at a time, and it is determined to stop the intake valves 12 or the exhaust valves 112 one after the other. Specifically, in the current cycle, only one set of the intake valves 12 and the exhaust valves 112 are stopped, and the other one set is stopped in the next cycle. There is no limitation on the sequence of stopping the valves. A stop of the intake valves 12 may be delayed, or a stop of the exhaust valves 112 may be delayed. By so doing, the Stop timings of the intake valves 12 and exhaust valves 112 with respect to crank angles are appropriately maintained, while overlap of duty 100% intervals of the intake side and exhaust side is prevented.

In step S324, it is determined whether the control on timing of the solenoid that is allowed to stop has come. When the timing has not yet come, the routine directly ends. Then, when the control on timing of the solenoid has come in each of the intake side and the exhaust side, the process proceeds to step S312, and then the command signals (control on signals) are output from the ECU 26 to the solenoids 68 and 168.

With the above routine, the stop timing of the intake valves 12 or the exhaust valves 112 with respect to a crank angle is appropriately maintained, while overlap of duty 100% intervals of the intake side and exhaust side may be prevented.

The embodiments of the invention are described above; however, the aspect of the invention is not limited to the above described embodiments. The aspect of the invention may be implemented in various forms without departing from the scope of the invention. For example, in the above described embodiments, the solenoids 68 and 168 are used as the drive devices of the actuators 66 and 166; instead, another drive device, such as hydraulic pressure, air pressure and a spring, may be used.

In addition, in the above described embodiments, the valve stop mechanism is provided as the valve operating characteristic changing mechanism; instead, in the aspect of the invention, the valve operating characteristic changing mechanism may be a valve mechanism described in JP-A-2006-520869. As long as the operating characteristics of the valve with respect to the rotation of the camshaft are configured to be changed by displacing an operating member in the axial direction, the valve operating characteristic changing mechanism is not limited to the valve stop mechanism.

In addition, in the above described embodiments, the spiral groove 64, which is the guide passage, is restricted from being displaced in the axial direction with respect to the camshaft 4, and the slide pin 58, which is the operating member, is restricted from being displaced in the axial direction with respect to the protruding portion 58*c*, which is the guided member. However, in the aspect of the invention, it is only necessary that the guide passage is restricted from rotating with respect to the camshaft, the guided member is able to be engaged with or disengaged from the guide passage, and the operating member is displaced in the axial direction of the camshaft through a relative displacement in the axial direction between the guide passage and the guided member, the relative displacement being caused by the rotation of the camshaft. Thus, the aspect of the invention may also be applied to control on the valve mechanism described in JP-A-2006-520869. This is because, in the valve mechanism described in JP-A-2006-520869, the cam carrier corresponds to the operating member, the spiral groove provided for the cam carrier corresponds to the guide passage and the drive pin engaged with or disengaged from the groove corresponds to the guided member.

The invention claimed is:

1. A controller for an internal combustion engine, the internal combustion engine including:

a rotational phase difference changing mechanism that changes a rotational phase difference of a camshaft with respect to a crankshaft;

a grooved guide passage that is formed on a portion of a peripheral surface of the camshaft;

a guided member that is able to be engaged with or disengaged from the grooved guide passage;

an operating member, connected to the guided member, that is displaced back and forth in a direction parallel to an axial direction of the camshaft through a relative displacement of the guided member when the guided member is engaged in the grooved guide passage, the relative displacement being caused by the rotation of the camshaft and a shape of the grooved guide passage;

a valve operating characteristic changing mechanism that changes operating characteristics of a valve with respect to the rotation of the camshaft through the relative displacement of the operating member; and an actuator that receives an input command signal to drive the guided member to thereby engage the guided member with the grooved guide passage, the the controller comprising:

an ECU configured to:

calculate a rotational position of the crankshaft;

calculate a rotational phase difference of the camshaft with respect to the crankshaft, the rotational phase difference being changed by the rotational phase difference changing mechanism;

output a command signal to the actuator when the operating characteristics of the valve are changed and that determines a timing, at which the command signal is output to the actuator, on the basis of the rotational position of the crankshaft; and correct the timing, at which the command signal is output on the basis of the rotational phase difference of the camshaft with respect to the crankshaft.

2. The controller according to claim 1, wherein in the internal combustion engine, the grooved guide passage is restricted from being displaced in the axial direction with respect to the camshaft, and the operating member is restricted from being displaced in the axial direction with respect to the guided member.

3. The controller according to claim 1, wherein the ECU is configured to correct the timing, at which the command signal is output, on the basis of a response delay time of the actuator with respect to the command signal and a rotational speed of the crankshaft.

4. The controller according to claim 1, wherein:

the ECU is configured to determine whether the rotational phase difference changing mechanism can normally operate, and the ECU is configured to prohibit from outputting the command signal when the rotational phase difference changing mechanism cannot normally operate.

5. The controller according to claim 1, wherein the internal combustion engine has the valve operating characteristic changing mechanism, the operating member, the grooved guide passage, the guided member and the actuator in each of an intake side and an exhaust side, the internal combustion engine has the rotational phase difference changing mechanism, the ECU is configured to output the command signal to each of the intake side and the exhaust side, the ECU is configured to calculate the rotational phase difference of the crankshaft with respect to the camshaft of at least one of the intake side and the exhaust side, the ECU is configured to correct the timing of the time when the command signal is output to at least one of the intake side and the exhaust side, and the ECU is configured to determine whether timings, at which command signals are respectively output to the intake side and the exhaust side and which are corrected, overlap, and the ECU is configured to adjust the timings, at which the command signals are output to the intake side and the exhaust side, so as to cancel the overlap when the output timings overlap.

6. The controller according to claim 2, wherein the ECU is configured to correct the timing, at which the command signal is output, on the basis of a response delay time of the actuator with respect to the command signal and a rotational speed of the crankshaft.

7. The controller according to claim 2, wherein:

the ECU is configured to determine whether the rotational phase difference changing mechanism can normally operate, and the ECU is configured to prohibit from outputting the command signal when the rotational phase difference changing mechanism cannot normally operate.

8. The controller according to claim 2, wherein the internal combustion engine has the valve operating characteristic changing mechanism, the operating member, the grooved guide passage, the guided member and the actuator in each of an intake side and an exhaust side, the controller has the instruction unit in each of the intake side and the exhaust side, the internal combustion engine has the rotational phase difference changing mechanism, the ECU is configured to output the command signal to each of the intake side and the exhaust side, and the ECU is configured to calculate the rotational phase difference of the crankshaft with respect to the camshaft of at least one of the intake side and the exhaust side, the ECU is configured to correct the timing of the time when the command signal is output to at least one of the intake side and the exhaust side, the ECU is further configured to determine whether timings, at which command signals are respectively output to the intake side and the exhaust side and which are corrected, overlap, and the ECU is configured to adjust the timings, at which the command signals are output to the intake side and the exhaust side, so as to cancel the overlap, when the output timings overlap.

9. The controller according to claim 3, wherein:

the ECU is configured to determine whether the rotational phase difference changing mechanism can normally operate, and the ECU is configured to prohibit from outputting the command signal when the rotational phase difference changing mechanism cannot normally operate.

10. The controller according to claim 3, wherein the internal combustion engine has the valve operating characteristic changing mechanism, the operating member, the grooved guide passage, the guided member and the actuator in each of an intake side and an exhaust side, the controller has the instruction unit in each of the intake side and the exhaust side, the internal combustion engine has the rotational phase difference changing mechanism, the ECU is configured to output the command signal to each of the intake side and the exhaust side, and the ECU is configured to calculate the rotational phase difference of the crankshaft with respect to the camshaft of at least one of the intake side and the exhaust side, the ECU is configured to correct the timing of the time when the command signal is output to at least one of the intake side and the exhaust side, the ECU is further configured to determine whether timings, at which command signals are respectively output to the intake side and the exhaust side and which are corrected, overlap, and the ECU is configured to adjust the timings, at which the command signals are output to the intake side and the exhaust side, so as to cancel the overlap, when the output timings overlap.

11. The controller according to claim 4, wherein the internal combustion engine has the valve operating characteristic changing mechanism, the operating member, the grooved guide passage, the guided member and the actuator in each of an intake side and an exhaust side, the controller has the instruction unit in each of the intake side and the exhaust side, the internal combustion engine has the rotational phase difference changing mechanism, the ECU is configured to output the command signal to each of the intake side and the exhaust side, and the ECU is configured to calculate the rotational phase difference of the crankshaft with respect to the camshaft of at least one of the intake side and the exhaust side, the ECU is configured to correct the timing of the time when the command signal is output to at least one of the intake side and the exhaust side, the ECU is further configured to determine whether timings, at which command signals are respectively output to the intake side and the exhaust side and which are corrected, overlap, and the ECU is configured to adjust the timings, at which the command signals are output to the intake side and the exhaust side, so as to cancel the overlap, when the output timings overlap.

* * * * *

UNITED STATES PATENT AND TRADEMARK OFFICE

CERTIFICATE OF CORRECTION

PATENT NO. : 8,935,076 B2
APPLICATION NO. : 13/259394
DATED : January 13, 2015
INVENTOR(S) : Ide et al.

It is certified that error appears in the above-identified patent and that said Letters Patent is hereby corrected as shown below:

In the specification,

At column 1, line 64, change “in Japanese, Patent” to -- in Japanese Patent --.

At column 6, line 48, change “34L and 344” to -- 34L and 34R --.

At column 6, line 53, change “of the changeover” to -- of the change-over --.

At column 6, line 59, change “the changeover” to -- of the change-over --.

At column 7, line 29, change “rocker aim 32” to -- rocker arm 32 --.

At column 8, line 33, change “pin 54L, is inserted” to -- pin 54L is inserted --.

At column 11, line 23, mathematical expression (1), change “=INSTPCRKB(CA)+VT(CA)INST-” to -- =INSTPCRKB(CA)+VT(CA)+INST- --.

At column 11, line 47, change “speed, of the” to -- speed of the --.

At column 11, line 60, change “camshaft 4. with” to -- camshaft 4 with --.

At column 12, line 14, change “mathematical. expression (1)” to -- mathematical expression (1) --.

At column 16, line 35, change “which output” to -- which are output --.

At column 17, line 46, mathematical expression (8), change “INSTPCRK(CA)-INSTPCRK(CA)+” to -- INSTPCRK(CA)=INSTPCRK(CA)+ --.

At column 18, line 66, change “the Stop timings” to -- the stop timings --.

In the claims,

At column 20, line 12, change “passage, the” to -- passage, --.

Signed and Sealed this
Twentieth Day of October, 2015

Michelle K. Lee

Michelle K. Lee
*Director of the United States Patent and Trademark Office*